US007645167B2

(12) United States Patent
Mellage et al.

(10) Patent No.: US 7,645,167 B2
(45) Date of Patent: Jan. 12, 2010

(54) METHOD AND APPARATUS FOR CONTROLLING ANTENNA CONNECTIVITY AS A FUNCTION OF ANTENNA ORIENTATION

(75) Inventors: Brian Francis Mellage, Raleigh, NC (US); Curtis W. Thornton, Cary, NC (US); Gerard James Hayes, Wake Forest, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 208 days.

(21) Appl. No.: 11/738,147

(22) Filed: Apr. 20, 2007

(65) Prior Publication Data

US 2008/0261546 A1 Oct. 23, 2008

(51) Int. Cl.
*H01R 25/00* (2006.01)

(52) U.S. Cl. ..... 439/638

(58) Field of Classification Search ..... 439/906, 439/916, 915, 692, 693, 694, 695, 696, 489, 439/11, 13, 638; 343/906, 702
See application file for complete search history.

(56) References Cited

U.S. PATENT DOCUMENTS 5,255,001 A 10/1993 Tamura et al.
5,524,284 A * 6/1996 Marcou et al. ..... 455/575.7
6,157,350 A * 12/2000 House et al. ..... 343/906
6,411,265 B1 * 6/2002 Tsai et al. ..... 343/906
2004/0033711 A1 2/2004 Loveless et al.
2004/0189544 A1 9/2004 Astrin

FOREIGN PATENT DOCUMENTS

FR 2691841 A1 12/1993
WO 01/28031 A1 4/2001

OTHER PUBLICATIONS

PCT—International Search Report dated Nov. 28, 2008, for Application No. PCT/US2008/053668, Filed Feb. 12, 2008.

* cited by examiner

*Primary Examiner*—Edwin A. Leon
(74) *Attorney, Agent, or Firm*—Coats & Bennett, P.L.L.C.

(57) ABSTRACT

Methods and apparatuses presented herein control antenna connectivity for a wireless communication device as a function of rotation of a connector assembly plugged into the device, such as where an external antenna or cable includes the connector assembly. Assuming the device has a mating connector for the external antenna that changes the connections of internal and external antennas as a function of the connector mating depth, the method comprises configuring the wireless communication device and/or the external antenna with a mechanical feature that changes the mating depth between the device's and the antenna's mating connectors responsive to external antenna rotation. In one embodiment, a body portion of the external antenna retains the mating connector and includes a cam feature or other mechanical feature that engages an edge or surface of the device as the antenna is rotated, thereby pushing the antenna out from the device.

29 Claims, 6 Drawing Sheets

METHOD AND APPARATUS FOR CONTROLLING ANTENNA CONNECTIVITY AS A FUNCTION OF ANTENNA ORIENTATION

BACKGROUND

1. Technical Field

The present invention generally relates to antennas, such as external antennas used on wireless communication devices, and particularly relates to controlling antenna connectivity as a function of antenna orientation.

2. Background

Wireless communication devices, such as PC Cards, mobile terminals, etc., often make use of internal antennas and external antennas. For example, it may be convenient (or practically necessary) to include an internal antenna within a PC Card. Incorporation of the internal antenna makes the card more convenient to use in a laptop or other such system, and makes it more robust physically, as external antennas may be more prone to damage.

However, external antennas commonly offer better performance, e.g., greater gain or sensitivity, as compared to the internal counterparts. The reasons for these performance advantages are varied, but may include the ability to implement external antennas in a larger or more appropriate size, and the ability to space external antennas further away from parasitic coupling elements and active sources of interference.

While the mechanisms for detachably connecting external antennas to wireless communication devices are varied, a typical approach involves the use of complementary mating connectors on the device and the antenna. Known, non-limiting examples of such connectors include "SSMB" connectors, "MC Card Adapters," "MMCX Adapters", "MCX-Plug Adapters," and "RP-MMCX Adapters."

Whether or not these industry-standard connectors are used, a couple of features or characteristics are common to many types of (RF) mating connectors. First, the mating connectors included in the wireless communication devices may include or be associated with switching elements—e.g., spring fingers or other displaceable contacts—that actively connect an external antenna when it is plugged in and correspondingly disconnect the internal antenna(s). Conversely, such mating connectors reconnect the internal antenna(s) when the external antenna's mating connector is unplugged.

Another common characteristic is that the above types of mating connectors allow an external antenna to be rotated while it is plugged in. That characteristic actually is desirable in terms of reducing stresses on the mating connectors which is especially important with surface mount connectors and other potentially vulnerable mechanical/electrical configurations. However, external antenna rotation also can be problematic.

For example, the external antenna may offer performance improvements over the internal antenna only for a restricted range of orientations. In such cases, the external antenna's performance may degrade as it is rotated downward or otherwise away from its preferred angular orientation to the extent that its performance is inferior to the internal antenna. Other considerations, such as undesired antenna coupling, also may come into play with excessive rotation of the external antenna away from its preferred or nominal angular orientation.

SUMMARY

Methods and apparatuses presented herein include a connector assembly that comprises a first mating connector configured to insertably mate with a corresponding second mating connector of another device, and a mating connector body fixedly retaining the first mating connector and having a mechanical feature that decreases a mating depth between the first and second mating connectors responsive to rotation of the first mating connector relative to the second mating connector. As non-limiting examples, the connector assembly may comprise part of a plug-in external antenna, or an antenna cable.

With the above connector assembly as an example basis, one method embodiment taught herein relates to controlling antenna connectivity for a wireless communication device as a function of rotation of an external antenna plugged into the device. Assuming the device has a mating connector for the external antenna that changes the active connections of internal and external antennas as a function of the connector mating depth between its mating connector and that of the external antenna, the method comprises configuring the wireless communication device and/or the external antenna with a mechanical feature that changes the mating depth between the device's and the antenna's mating connectors responsive to external antenna rotation.

In one or more embodiments, a body portion of the external antenna retains the mating connector and includes a cam feature or other mechanical feature that engages an edge or surface of the device as the antenna is rotated, thereby pushing the antenna out from the device. The mechanical feature can be configured to allow full mating depth between the mating connectors of the external antenna and the device for a first range of rotational angles, and can be configured to begin changing, e.g., progressively, the mating depth as that first range of rotational angles is exceeded.

DETAILED DESCRIPTION

Figure 1:
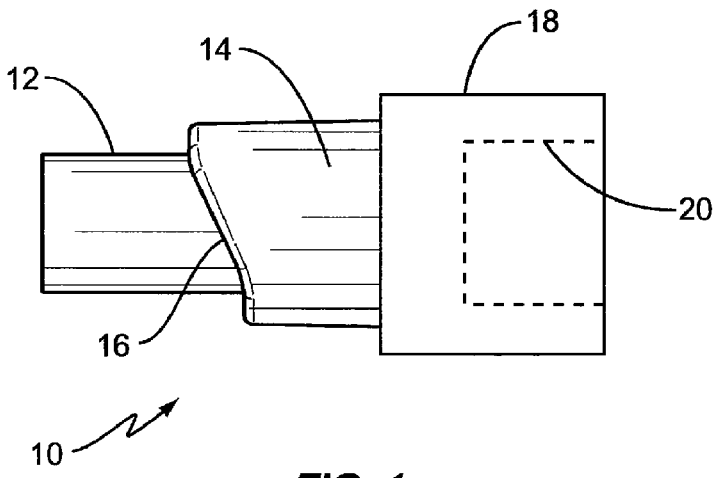
FIG. 1 is a side view of one embodiment of a connector assembly having a mechanical feature to control its plugged-in mating depth as a function of its rotation.
Figure 2:
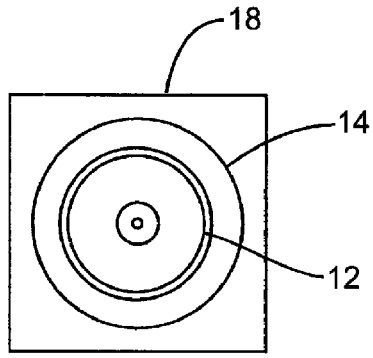
FIG. 2 is a front view of the connector assembly of FIG. 1.

FIG. 1 illustrates a side view of one embodiment of a connector assembly 10, while FIG. 2 provides a front view of the same assembly 10. The illustrated connector assembly 10 comprises a first mating connector 12, e.g., a pin, which is configured to insertably mate with a corresponding second mating connector of another device (not shown). The connector assembly 10 includes a mating connector body element 14, which fixedly retains the first mating connector 12 and has a mechanical feature 16 that decreases a mating depth between the first and second mating connectors responsive to rotation of the first mating connector relative 12 to the second mating connector. The connector body element 14 may be attached to or integral with a housing 18, which may house or otherwise fixedly retain another connector 20.

In one embodiment, the connector assembly 10 is implemented as a standalone item, as opposed to being integrated into an antenna or cable assembly. In at least one such embodiment, the housing 18 includes a connector 20, which may be implemented as a different type (form factor) from that of the mating connector 12, which allows the connector assembly 10 to act as a connector adaptor.

Whether or not the connector assembly 10 is implemented as an adaptor, in one or more of its embodiments, the mechanical feature 16 comprises a cam feature, such as can be achieved by forming or machining the edge of the connector body element 14, which circumferentially surrounds the mating connector 12, as best seen in FIG. 2. With this approach, a cam profile can be selected or otherwise configured to achieve the desired behavior in response to rotation of the connector assembly 10. For example, the cam profile may allow full mating depth between the mating connector 12 and whatever it is plugged into, for a first range of rotational angles, and may engage after that first range is exceeded, thereby decreasing the connector mating depth.

Figure 3:
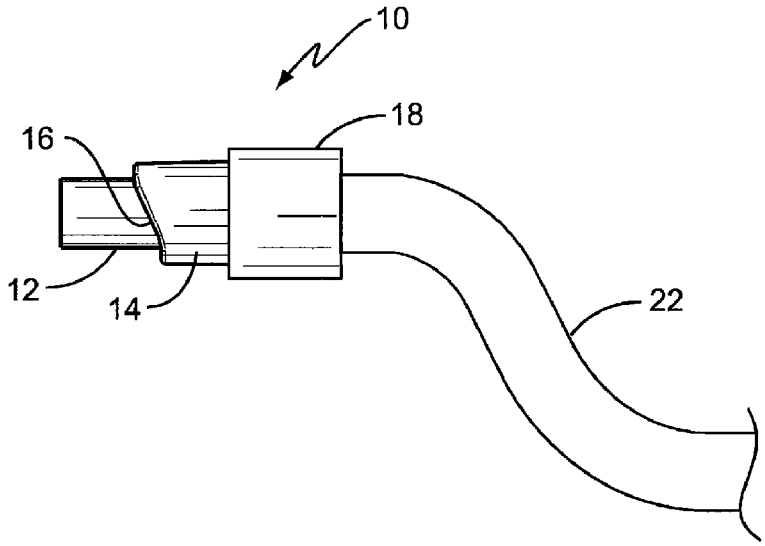
FIG. 3 is a side view of an (antenna) cable incorporating a connector assembly having a mechanical feature to control its plugged-in mating depth as a function of its rotation.
Figure 4:
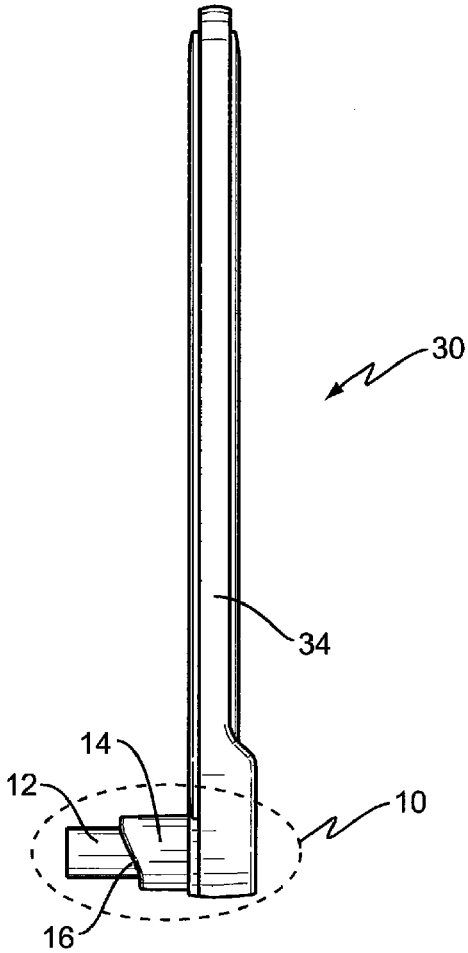
FIG. 4 is a side view of one embodiment of an external antenna a connector assembly having a mechanical feature to control its plugged-in mating depth as a function of antenna rotation.

The same idea can be applied to integrated systems or devices that are intended to plug into other things. For example, FIG. 3 illustrates an embodiment of the connector assembly 10, wherein it is included with, or otherwise integrated with a cable 22, such as an external antenna cable. Along the same lines, and as another non-limiting example, FIG. 4 illustrates the connector assembly 10 implemented as part of a plug-in external antenna 30.

The illustrated external antenna 30 comprises an antenna body 34, which may subsume or otherwise include the housing 18 of the connector assembly 10. For example, in the illustrated embodiment, the connector body element 14 attaches to or integrates with the antenna body 34, at a connector end of the antenna 30.

With the illustrated configuration, the external antenna 30 can be conveniently plugged into a complementary mating connector of another device. With that in mind, in the embodiment illustrated, the mechanical feature 16 changes the mating depth of the mating connector 12 (when it is plugged into a complementary mating connector) responsive to rotation of the external antenna 30. In other words, the mechanical feature 16 causes mechanical interference between the external antenna 30 and the device it is plugged into, at least for some range of rotational angles, and that mechanical interference tends to push the external antenna 30 out (away from) the device, such that the mating connector 12 is at least partially withdrawn.

Figure 5:
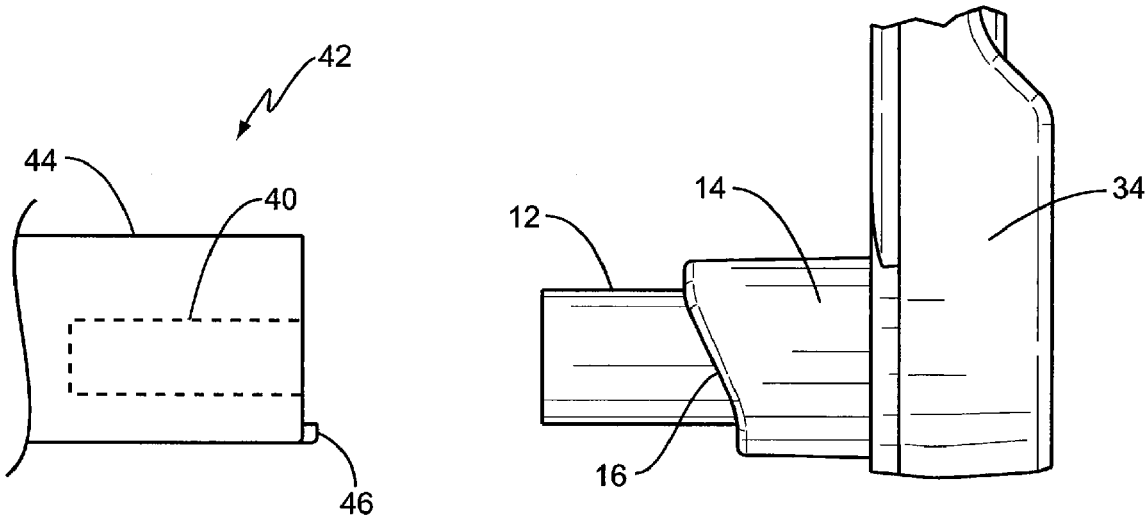
FIG. 5 is a side view, showing a connector end of the antenna of FIG. 4 in more detail, and further depicting a wireless communication device into which the antenna is plugged.

FIG. 5 illustrates the connector end of the external antenna 30 in more detail, and provides context for better understanding the illustrated embodiment of the mechanical feature 16. As seen in the drawing, the mating connector 12 of the external antenna 30 plugs into a corresponding mating connector 40, which is included in a wireless communication device 42, e.g., a PC Card, cellular telephone, or other such equipment. The embodiment of the wireless communication device 42 shown in the diagram includes a body or housing 44, which includes or otherwise incorporates a surface or edge 46 that mechanically interferes with the mechanical feature 16 of the external antenna 30, when the external antenna 30 is plugged into the wireless communication device 42 and rotated with respect to it.

Figure 6:
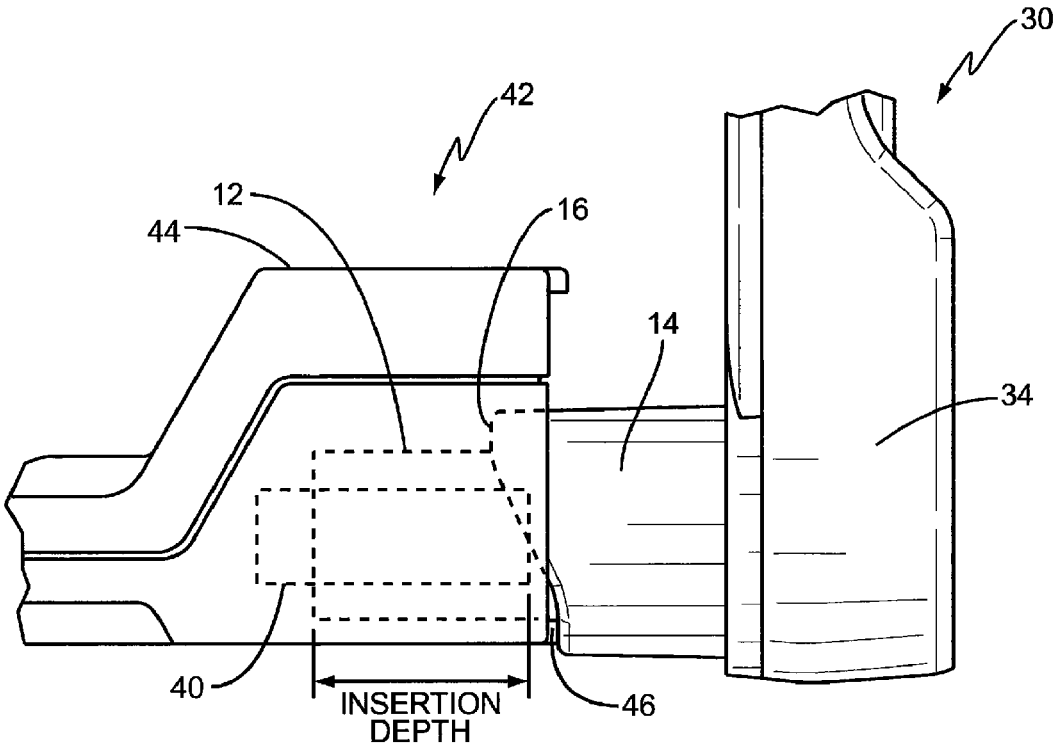
FIG. 6 is a side view of an embodiment of an external antenna and a wireless communication device, wherein the mating depth between device and antenna mating connectors is illustrated.

More particularly, the mechanical feature 16 shown in FIG. 5 comprises a cam feature implemented on or as part of the mating connector body element 14, which surrounds the mating connector 12. This configuration provides a cam surface profile that engages the edge 46 of the wireless communication device 42 as the external antenna 30 is rotated. Notably, however, as shown in FIG. 6, the mechanical feature 16 is, in one or more embodiments, designed to allow the mating connector 12 of the external antenna 30 to be fully mated with the mating connector 40 of the wireless communication device 42 for at least some angular orientations of the external antenna 30 relative to the wireless communication device 42. That is, for at least some range of angular rotation, the cam profile of the mechanical feature 16 does not engage with the edge 36 of the wireless communication device 42. Therefore, the mating connectors 12 and 40 remain fully mated (full insertion depth) over some range of external antenna rotation.

Indeed, one sees from the illustration that the rotational angle at which the mechanical feature 16 begins interfering with the edge 36 (or other body/surface part) of the wireless communication device 42 can be controlled by the cam profile of the mechanical feature 16. One also sees that the maximum degree or extent to which the mechanical feature withdraws the mating connector 12 from the mating connector 40 as a function of external antenna rotation can be controlled by the cam profile.

Figure 7:
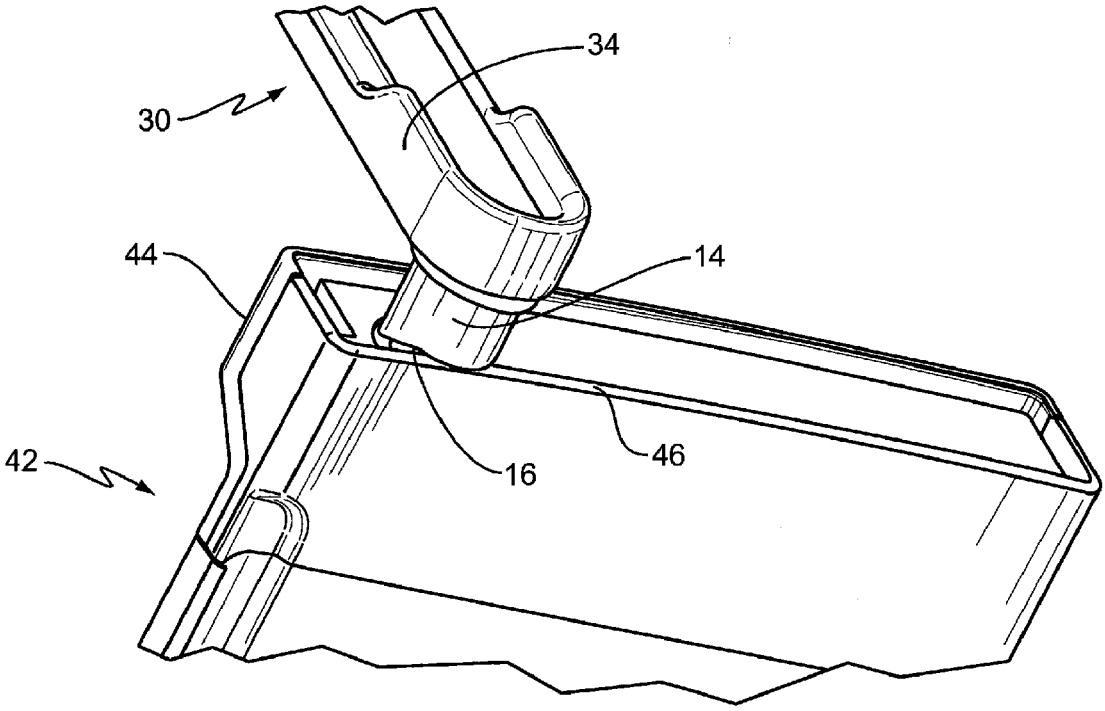
FIGS. 7 and 8 are perspective views of the antenna and wireless communication device of FIG. 6, and illustrate operation of the mechanical feature for two different antenna rotations.
Figure 8:
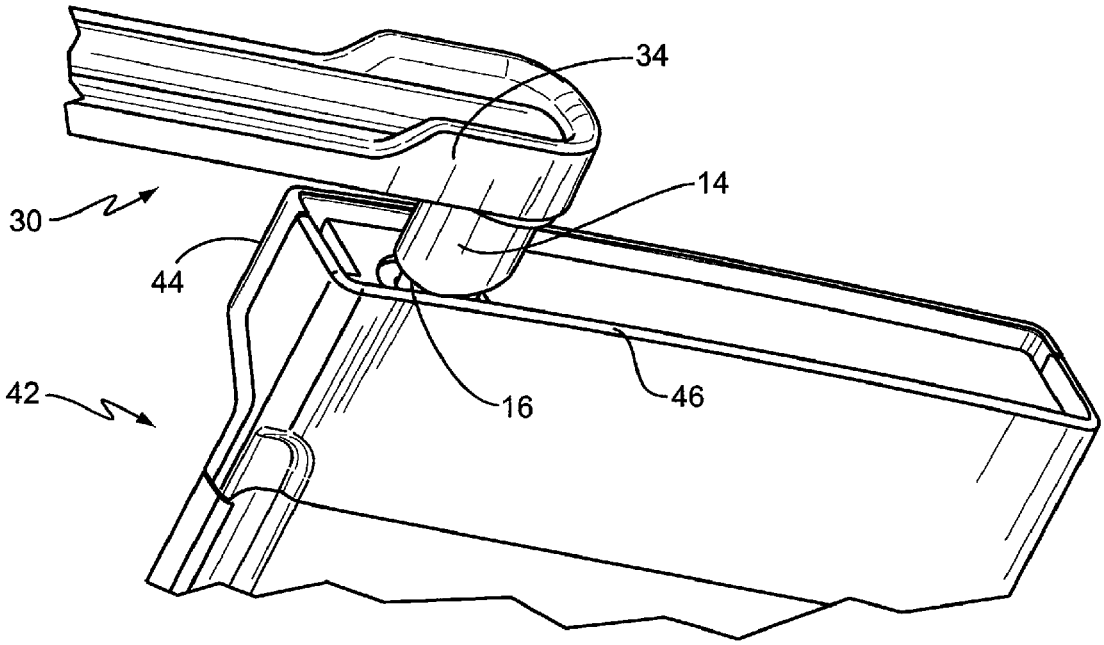

FIGS. 7 and 8 provide two perspective views illustrating operation of the mechanical feature 16. In FIG. 4, the external antenna 30 is plugged into the wireless communication device 42 and may be considered to be in a vertical orientation with respect to the wireless communication device. Assuming for this example that the vertical orientation is considered nominal or otherwise desirable, the mechanical feature 16 is formed or otherwise configured not to cause mechanical interference between the wireless communication device 42 and the external antenna 30 for the nominal orientation. That is, the mechanical feature 16 is configured to allow the external antenna 30 to remain fully plugged into the wireless communication device 42, at least when the external antenna 30 is in its nominal orientation. To that end, one sees that the lower portion of the cam profile of the mechanical feature 16 "clears" the edge 46 of the wireless communication device 42, thereby allowing the mating connector 12 of the external antenna 30 to achieve full mating depth with the mating connector 40 of the wireless communication device.

On the other hand, FIG. 8 depicts circumstances where the external antenna 30 has been rotated 90 degrees away from its nominal position. One sees that the mechanical feature 16 has engaged the edge 46 because of the antenna rotation, and that the cam profile of the mechanical feature 16 has caused that physical engagement to withdraw (or begin withdrawing) the mating connector 12 of the external antenna 30 from the mating connector 40 of the wireless communication device 42. Put simply, the cam profile of the mechanical feature 16 creates an axial withdrawal force between the mating connectors 12 and 40, such that the external antenna 30 is "pushed" away from the body 44 of the wireless communication device 42 as progressive rotation of the external antenna 30 causes the cam profile of the mechanical feature 16 to progressively engage the edge 46.

Figure 9:
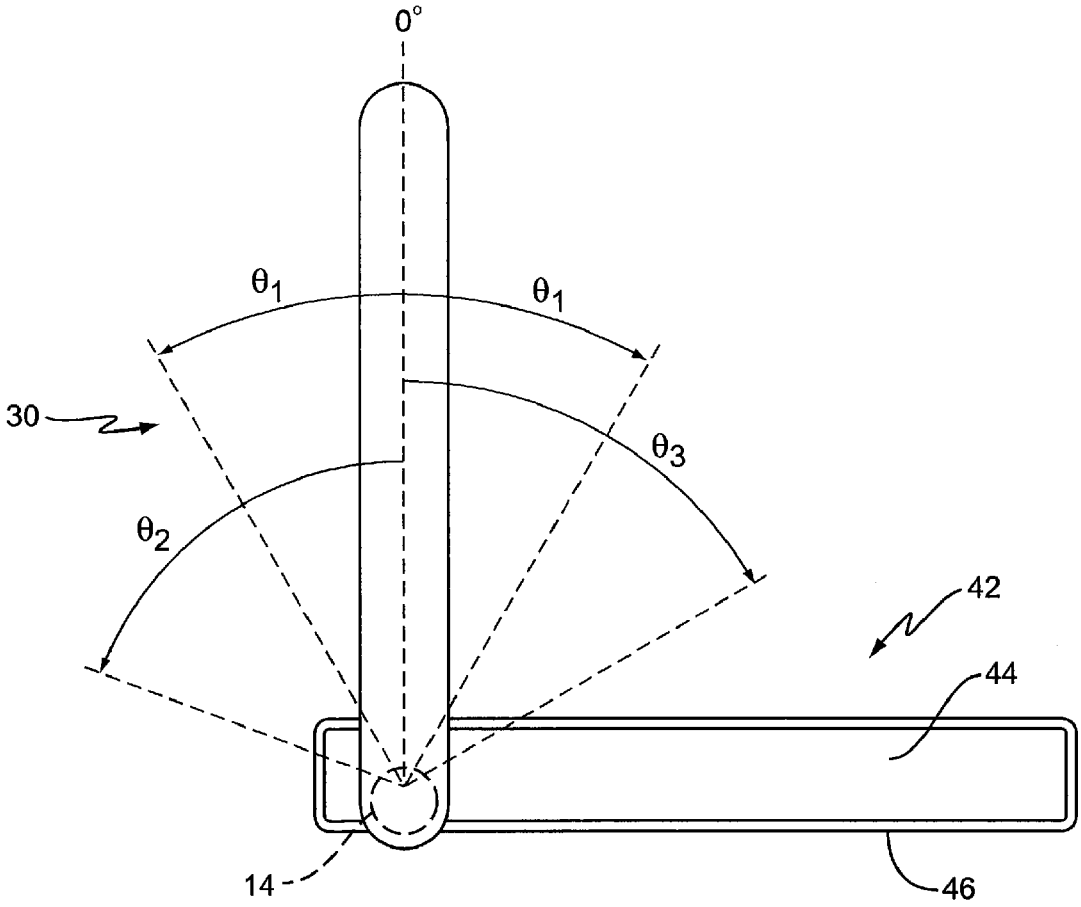
FIG. 9 is a back view of an embodiment of an external antenna and wireless communication device, wherein a number of rotational angle ranges for the external are shown.

FIG. 9 provides further details regarding the angle-based functionality of the mechanical feature 16, for one or more embodiments of the external antenna 30 and/or wireless communication device 42. For reference, rotational angles are depicted relative to a centerline of the external antenna 30, for a vertical antenna orientation.

With that relative framework used as the angular reference, the mechanical feature 16 may be configured to allow a full mating depth between the connectors 12 and 40 for a first range of angles (up to $\theta_1$ on either side of the centerline). Again, if implemented as a cam feature, a cam profile of the mechanical feature 16 can be configured to allow full mating over the angular range defined by $\pm\theta_1$.

Further, the mechanical feature 16 can be configured to cause a maximum withdrawal (i.e., a maximum decrease in mating depth) for rotational angles beyond $\theta_2$. (While $\theta_2$ is shown only with respect to one side of the centerline, it should be understood that rotating the external antenna 30 more than $\theta_2$ away from the centerline in either direction, i.e., $\pm\theta_2$, produces the same result.) Still further, and particularly with cam-based embodiments that conveniently provide for progressive mating depth changes with progressive antenna rotation, the mating feature 20 may be configured to produce intermediate changes (i.e., changes between zero withdrawal and maximum withdrawal) for angles $\theta_3$, that are greater than angles $\theta_1$ and less than angles $\theta_2$.

As a non-limiting example, the mechanical feature 16 of the external antenna 30 can be configured to change the mating depth between the mating connectors 14 and 40, such that the mating connector 40 actively connects the external antenna 30 and disconnects an internal antenna (not shown) of the wireless communication device 42 for a first rotational angle of the external antenna 30, and actively connects the internal antenna and disconnects the external antenna 30 for a second rotational angle of the external antenna 30.

Broadly, then, the mechanical feature 16 is, in one or more embodiments, configured as a cam feature that allows full mating depth between the mating connectors 12 and 40 (as first and second mating connectors) for a first range of rotational angles between the external antenna 30 and the wireless communication device 42, and that decreases the mating depth as the first range of rotational angles is exceed. (Of course, it is contemplated herein to implement other non-cam arrangements of the mechanical feature 16 to effect the same or similar operations.)

Advantageously, the above configuration may be based on setting the first range of rotation as a function of known performance of the external antenna 30, such that the extents of the first range of rotation correspond to desired performance degradation limits of the external antenna 30. In other words, the external antenna 30 may not work well once it is rotated beyond a given range of angles. As an example, a vertically polarized version of the external antenna 30 may not work as well as an internal antenna of the wireless communication device 42 once the external antenna 30 is rotated too far away from a nominal vertical orientation.

Thus, assuming that the connector 40 of the wireless communication device 42 is configured to control the connectivity of its internal antenna (not shown) and the external antenna 30 as a function of the mating depth between the mating connectors 40 and 14, the mechanical feature 16 can be configured, for rotational angles beyond a desired limit, to change the mating depth enough to cause disconnection of the external antenna 30 and reconnection of the internal antenna. Similarly, the connector 40 of the wireless communication device 42 also may be configured to simultaneously connect both the internal antenna and the external antenna 30 for some intermediate range of insertion depths between the connectors 40 and 12, such as for diversity operation.

In the above scenario, full mating depth causes the connector 40 to disconnect the internal antenna and connect the external antenna 30. Intermediate rotation of the external antenna 30 causes the mechanical feature 16 to cause an intermediate change (decrease) in the mating depth of the connectors 40 and 12, thereby causing the connector 40 to connect both the internal antenna and the external antenna 30 for diversity operation. Further rotation of the external antenna 30 would cause the mechanical feature to cause a greater (possibly maximum) change in the mating depth of the connectors 40 and 12, thereby causing the connector 40 to disconnect the external antenna 30, leaving only the internal antenna connected. Of course, more complex arrangements are contemplated herein, such as where the wireless communication device 42 has more than one internal antenna, and changes in mating depth caused by rotation of the external antenna 30 produce different active antenna combinations.

Figure 10:
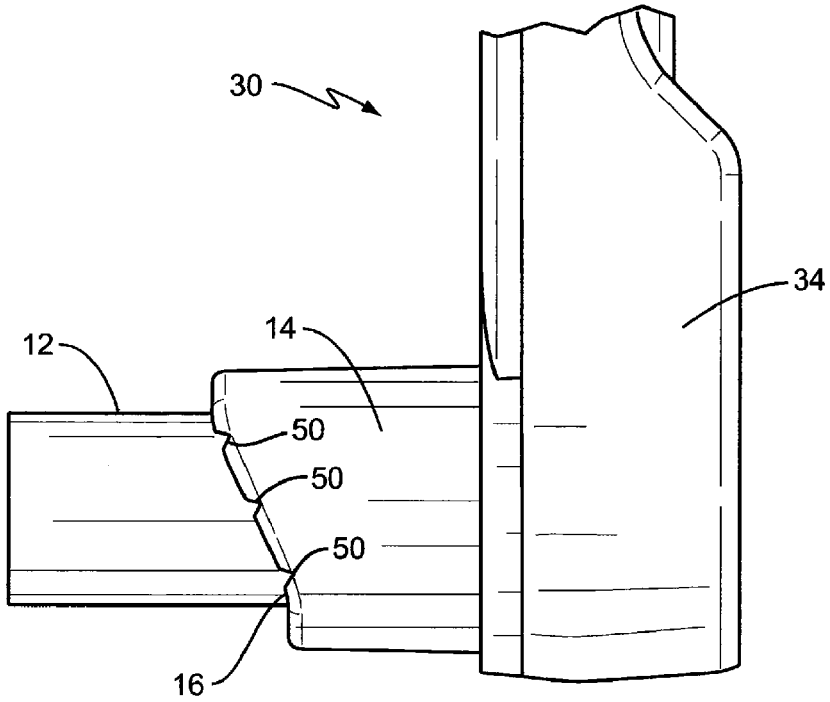
FIG. 10 is a side view of an embodiment of a connector end of an external antenna, wherein the mechanical feature for controlling mating depth as a function of antenna rotation is a cam feature having stops or other surface features corresponding to rotational angles that, in turn, correspond to different internal/external antenna connections of a wireless communication device.

FIG. 10 depicts an embodiment of the external antenna 30 which may be particularly advantageous in the above context. More particularly, the mechanical feature 16 is configured such that its cam profile include stops or other surface features 50 corresponding to different internal/external antenna connectivity configurations. That is, with knowledge of the antenna connectivity behavior for the connector 40 within the wireless communication device 42, the cam profile can be specifically tailored with predefined stop positions for antenna rotation angles corresponding to desired internal/external antenna connectivity.

Figure 11:
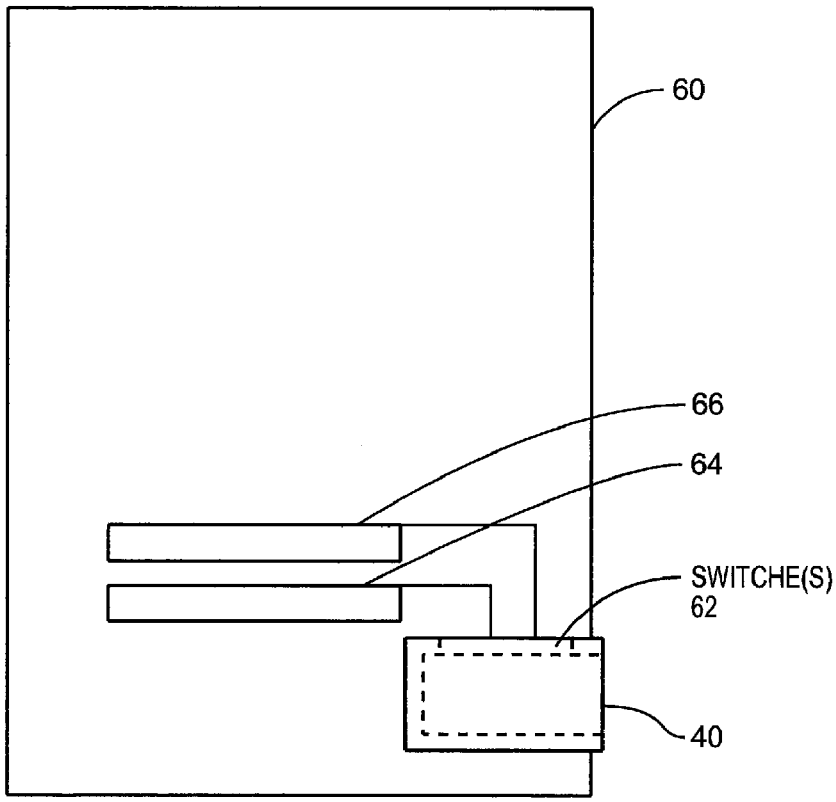
FIG. 11 is a top view of an embodiment of a circuit board or other carrier having a mating connector for an external antenna, wherein the connector includes switches that connect/disconnect one or more internal antennas and the external antenna as a function of the mating depth between the device's connector and that of the external antenna.

Such operations are illustrated in FIG. 11, which depicts a circuit board or other carrier 60 included within the wireless communication device 42, wherein the connector 40 may be mounted or otherwise affixed to the carrier 60. Regardless of such details, the connector 40 includes one or more switches 62—such as leaf springs or other displaceable fingers—that control whether one or more internal antennas (64 and 66 are shown as a non-limiting example) are connected or disconnected, based on the mating depth between the connectors 40 and 12. Connector 12 is not shown plugged into connector 40 in FIG. 11 to simplify the illustration, but it should be understood that, whether connector 40 is male and connector 12 is female, or vice versa, the two connectors insertably mate together at some maximum insertion depth, and that operation of the mechanical feature 16 causes that insertion depth to change, whether continuously or discontinuously, as the external antenna 30 is rotated relative to the wireless communication device 42.

Thus, with the above embodiments of the external antenna 30 in mind as non-limiting examples, those skilled in the art will appreciate that the teachings herein broadly contemplate an external antenna 30 for coupling to an external antenna connection, e.g., connector 40, of a wireless communication device 42. The external antenna 30 comprises, in one or more embodiments, a first mating connector, e.g., connector 12, configured to insertably mate with a second mating connector, e.g., connector 40, of the wireless communication device 42, and an antenna body 34 retaining the first mating connector 12. For example, the mating connector body element 14 integrated with the antenna body 34. Further, the external antenna 30 has a mechanical feature 16 configured to control a mating depth between the first and second mating connectors 12 and 40 responsive to a rotational angle of the external antenna 30 relative to the wireless communication device 42.

In at least one such embodiment, the mechanical feature 16 comprises a cam feature that contacts an edge or surface, e.g., edge 46, of the wireless communication device 42 as the rotational angle increases beyond a desired angular range, thereby exerting an axial withdrawal force between the first and second mating connectors 12 and 40. The cam feature comprises an angled end element, see, e.g, FIG. 5 for a side view of the mating connector body element 14, whose end is angled to form the mechanical feature 16. As shown, the angled end of the mating connector body element 14 surrounds and retains the first mating connector 12.

Correspondingly, a method of controlling antenna connectivity for a wireless communication device 42 is contemplated herein, wherein the wireless communication device 42 has a first mating connector, e.g., connector 40, for the external antenna 30 that changes internal/external antenna connectivity as a function of a connector mating depth between the mating connector 40 and the mating connector 12 of the external antenna 30. In one or more embodiments, the method comprises configuring at least one of the wireless communication device 42 and the external antenna 30 with a mechanical feature, e.g., mechanical feature 16, that changes the mating depth between the mating connectors 40 and 12 responsive to rotation of the external antenna 30.

Figure 12:
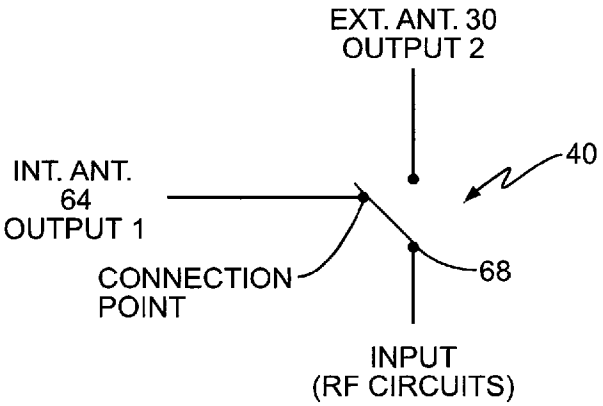
FIGS. 12 and 14 are schematic views of one embodiment of an external antenna mating connector that controls internal/external antenna connectivity as a function of connector mating depth, while FIGS. 13 and 15, respectively, are corresponding block diagrams of connector switch positions for un-mated and mated connector conditions.

FIGS. 12-15 illustrate supporting structure for carrying out the above method according to one or more embodiments. Particularly, FIG. 12 illustrates a switch 68 (e.g., a SPDT switch) within the connector 40 of the wireless communication device 42, which may be one of the earlier illustrated switches 62. In any case, the switch 68 either connects to a first output (Output 1), which is associated with the internal antenna 64, for example, or to a second output (Output 2), which is associated with the external antenna 30. Either of these two outputs is electrically connected to a common terminal (labeled Input) of the switch 68, which may in turn be coupled to one or more RF inputs of RF circuitry within the wireless communication device 42.

Figure 13:
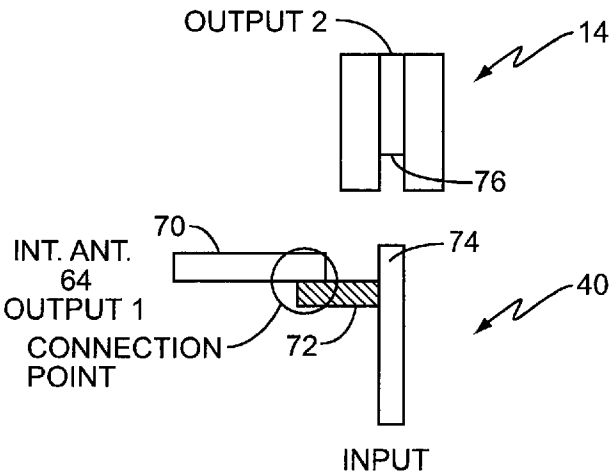

FIG. 13 illustrates one embodiment for providing the above switched connectivity, wherein a first contact finger 70 touches a second contact finger 72 that in turn is connected with a common contact 74. This default electrical connectivity exists until the mating connector 14 is plugged in, meaning that the internal antenna 64 is connected to the RF circuitry of the wireless communication device 42 if the external antenna 30 is not plugged in (or at least is connected until the mating connector 14 achieves sufficient mating depth with the mating connector 40).

Figure 14:
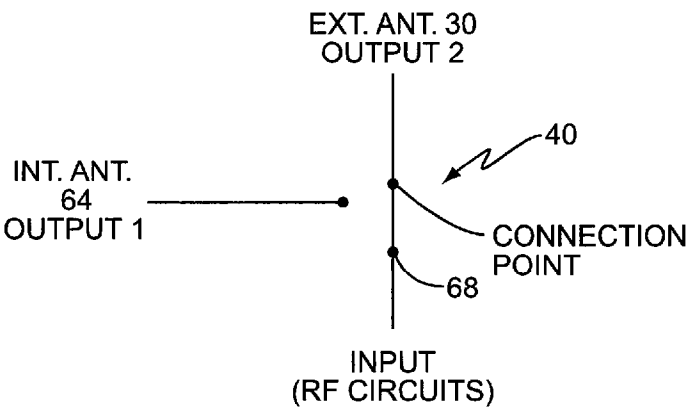
Figure 15:
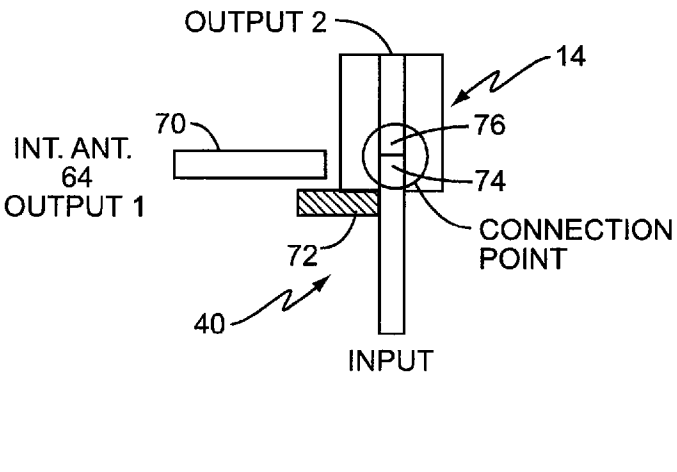

FIGS. 14 and 15 show the opposite switch condition, wherein the mating connector 14 has been plugged into the mating connector 40 with a mating depth sufficient to disengage contact finger 72 from contact finger 70, and to engage a contact 76 of the mating connector 14 with the common contact 74 of the mating connector 40, thereby electrically connecting the external antenna 30 to the RF circuitry of the wireless communication device 42. Of course, the mating connector 40 can be modified to included additional switch contacts actuated at intermediate mating depths, for example. Such additional switched contacts can be used to implement simultaneous connection of internal/external antennas for example.

With that in mind, it is notable that the mechanical feature 16 may, as noted herein, be configured as a cam feature that allows full mating depth between the mating connectors 40 and 12 for a first range of rotational angles between the external antenna 30 and the wireless communication device 42, and that decreases the mating depth as the first range of rotational angles is exceed.

Also, as noted, the antenna connectivity control methods taught herein may include configuring a mechanical feature to permit a full mating depth between the mating connectors 40 and 12 for a first range of rotation of the external antenna 30 relative to the wireless communication device 42, and to decrease the mating depth as the external antenna 30 is rotated beyond the first range of rotation. The first range of rotation may be set or otherwise defined as a function of known performance of the external antenna 30, such that the extents of the first range of rotation correspond to desired performance degradation limits of the external antenna 30.

Broadly, either or both the wireless communication device 42 and the external antenna 30 include one or more physical features that cause mechanical interference as the external antenna 30 is rotated relative to the wireless communication device 42. This mechanical interference tends to push the external antenna 30 away from the wireless communication device 42, i.e., the mechanical interference imparts axial force that tends to separate the two connectors 40 and 12. For example, a cam surface may be implemented on the body 44 of the wireless communication device 42 proximate to the connector 40, such that rotation of the external antenna 30 causes the mating connector body element 14 of the external antenna 30 to engage the cam surface. (Alternatively, the mating connector 40 itself may be configured to include a cam surface as part of its housing.) As already illustrated, the mechanical feature may be implemented on the external antenna 30, and/or both the external antenna 30 and the wireless communication device 42 may have complementary mechanical features that change connector mating depth as a function of antenna rotation.

Of course, the present invention is not limited to the above features and advantages. It is broadly contemplated herein to include one or more mechanical features on an external antenna and/or on a wireless communication device that change the mating depth of the connectors responsive to rotation of the external antenna. As such, the present invention is not limited by the foregoing description and accompanying illustrations, but rather is limited only by the following claims and their legal equivalents.

What is claimed is:

1. A connector assembly comprising:

a first mating connector configured to insertably mate with a corresponding second mating connector of another device; and a mating connector body fixedly retaining the first mating connector and having a mechanical feature that decreases a mating depth between the first and second mating connectors responsive to rotation of the first mating connector relative to the second mating connector, wherein the mechanical feature comprises a cam feature that allows full mating depth between the first and second mating connectors for a first range of rotational angles and that decreases the mating depth as the first range of rotational angles is exceeded.

2. The connector assembly of claim 1, wherein the mechanical feature comprises a cam feature that is configured to mechanically engage a surrounding surface of the second mating connector as the first connector is rotated relative to the second connector, thereby exerting an axial withdrawal force on the first mating connector.

3. The connector assembly of claim 2, wherein the connector assembly comprises part of an external antenna, and wherein the mating connector body, including the cam feature is formed in a connector end of the external antenna.

4. The connector assembly of claim 2, wherein the connector assembly comprises part of an antenna cable, and wherein the mating connector body, including the cam feature, is formed in a connector end of the antenna cable.

5. The connector assembly of claim 2, wherein the connector assembly comprises part of a connector adaptor, and wherein the mating connector body, including the cam feature, comprises part of a connector adaptor body.

6. A method of controlling antenna connectivity for a wireless communication device having a first mating connector for an external antenna that changes the active connections of an internal antenna and the external antenna as a function of a connector mating depth between the first mating connector and a second mating connector of the external antenna, said method comprising configuring at least one of the wireless communication device and the external antenna with a mechanical feature that changes the mating depth between the first and second mating connectors responsive to rotation of the external antenna, and further comprising configuring the mechanical feature as a cam feature that allows full mating depth between the first and second mating connectors for a first range of rotational angles between the external antenna and the wireless communication device, and that decreases the mating depth as the first range of rotational angles is exceeded.

7. The method of claim 6, further comprising configuring a cam profile of the cam feature to include stops or other surface features corresponding to different internal/external antenna connectivity configurations.

8. The method of claim 6, further comprising setting the first range of rotational angles as a function of known performance of the external antenna, such that the extents of the first range of rotational angles correspond to desired performance degradation limits of the external antenna.

9. The method of claim 6, wherein configuring at least one of the wireless communication device and the external antenna with a mechanical feature that changes the mating depth between the first and second mating connectors responsive to rotation of the external antenna comprises including one or more physical features on one or both the wireless communication device and the external antenna that cause mechanical interference as the external antenna is rotated relative to the wireless communication device.

10. The method of claim 6, wherein configuring at least one of the wireless communication device and the external antenna with a mechanical feature that changes the mating depth between the first and second mating connectors responsive to rotation of the external antenna comprises configuring the mechanical feature to change the mating depth such that the first mating connector actively connects the external antenna and disconnects the internal antenna for a first rotational angle of the external antenna, and actively connects the internal antenna and disconnects the external antenna for a second rotational angle of the external antenna.

11. The method of claim 10, further comprising configuring the mechanical feature to change the mating depth such that the first mating connector actively connects both the internal and external antennas for a third rotational angle of the external antenna between the first and second rotational angles.

12. A method of configuring a plug-in external antenna to electrically disconnect from a mating connector of a wireless device into which it is plugged as a function of rotation of the external antenna relative to the wireless communication device, the method comprising configuring the external antenna to include a mechanical feature that decreases a mating depth between the external antenna with the mating connector of the wireless communication device responsive to rotation of the external antenna, wherein the mechanical feature comprises a cam feature that allows full mating depth between the first and second mating connectors for a first range of rotational angles and that decreases the mating depth as the first range of rotational angles is exceeded.

13. The method of claim 12, wherein the mechanical feature is configured to exert an axial withdrawal force on the external antenna as the external antenna is rotated relative to the wireless communication device.

14. The method of claim 12, wherein the mechanical feature comprises a cam feature formed at a connector end of the external antenna, said connector end retaining a mating connector configured for mating with the mating connector of the wireless communication device.

15. The method of claim 14, wherein the external antenna includes an antenna body having a first portion and a second portion, said first and second portion joined together in substantially perpendicular fashion, and said second portion terminating in the connector end of the external antenna.

16. An external antenna for coupling to an external antenna connection of a wireless communication device, said external antenna comprising:

a first mating connector configured to insertably mate with a second mating connector of the wireless communication device; and an antenna body retaining the first mating connector and having a mechanical feature configured to control a mating depth between the first and second mating connectors responsive to a rotational angle of the external antenna relative to the wireless communication device, wherein the mechanical feature comprises a cam feature that contacts an edge or surface of the wireless communication device as the rotational angle increases beyond a desired angular range, thereby exerting an axial withdrawal force between the first and second mating connectors.

17. The external antenna claim 16, wherein the cam feature comprises an angled end element of the antenna body, said angled end element surrounding and retaining the first mating connector.

18. The external antenna of claim 16, wherein a cam profile of the cam feature includes stops or other surface features corresponding to different internal/external antenna connectivity configurations controlled by the second mating connector as a function of the mating depth between the first and second mating connectors.

19. The external antenna of claim 16, wherein the mechanical feature is configured to allow a full mating depth between the first and second mating connectors for a first range of rotational angles, and to decrease the mating depth as the first range of rotational angles is exceeded.

20. The external antenna of claim 16, wherein the mechanical feature is configured to allow a first range of rotational angles over which a full mating depth between the first and second mating connectors is maintained, and further comprising setting the first range of rotational angles as a function of known performance of the external antenna.

21. The external antenna of claim 16, wherein the mechanical feature is configured to change the mating depth between the first and second mating connectors such that the second mating connector actively connects the external antenna and disconnects an internal antenna of the wireless communication device for a first rotational angle of the external antenna, and actively connects the internal antenna and disconnects the external antenna for a second rotational angle of the external antenna.

22. The external antenna of claim 21, wherein the mechanical feature is configured to change the mating depth between the first and second mating connectors such that the second mating connector actively connects both the internal and external antennas for a third rotational angle of the external antenna between the first and second rotational angles.

23. A wireless communication device comprising:

a first mating connector configured to mate with a second mating connector of a plug-in external antenna and to control active connectivity of the external antenna and an internal antenna of the wireless communication device as a function of a mating depth between the first and second mating connectors; and a mechanical feature integrated with or disposed proximate the first mating connector and configured to control a mating depth between the first and second mating connectors responsive to a rotational angle of the external antenna relative to the wireless communication device, wherein the mechanical feature comprises a cam feature that contacts the external antenna as the rotational angle increases beyond a desired angular range, thereby exerting an axial withdrawal force between the first and second mating connectors.

24. The wireless communication device of claim 23, wherein the cam feature comprises a beveled surface proximate to the first mating connector on a housing of the wireless communication device.

25. The wireless communication device of claim 23, wherein a cam profile of the cam feature includes stops or other surface features corresponding to different internal/external antenna connectivity configurations controlled by the first mating connector as a function of the mating depth between the first and second mating connectors.

26. The wireless communication device of claim 23, wherein the mechanical feature is configured to allow a full mating depth between the first and second mating connectors for a first range of rotational angles, and to decrease the mating depth as the first range of range of rotational angles is exceeded.

27. The wireless communication device of claim 23, wherein the mechanical feature is configured to allow a first range of rotational angles over which a full mating depth between the first and second mating connectors is maintained, and further comprising the mechanical feature to define the first range of rotational angles as a function of known performance of the external antenna.

28. The wireless communication device of claim 23, wherein the mechanical feature is configured to change the mating depth between the first and second mating connectors such that the first mating connector actively connects the external antenna and disconnects an internal antenna of the wireless communication device for a first rotational angle, and actively connects the internal antenna and disconnects the external antenna for a second rotational angle.

29. The wireless communication device of claim 28, wherein the mechanical feature is configured to change the mating depth between the first and second mating connectors such that the first mating connector actively connects both the internal and external antennas for a third rotational angle between the first and second rotational angles.

* * * * *